US006629789B2

(12) United States Patent
Kawatoko

(10) Patent No.: US 6,629,789 B2
(45) Date of Patent: Oct. 7, 2003

(54) PRINTING APPARATUS, DRIVING CONDITION SETTING METHOD FOR PRINTHEAD, AND STORAGE MEDIUM

(75) Inventor: Norihiro Kawatoko, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/791,591

(22) Filed: Feb. 26, 2001

(65) Prior Publication Data

US 2001/0024583 A1 Sep. 27, 2001

(30) Foreign Application Priority Data

Feb. 28, 2000 (JP) ..... 2000-052327

(51) Int. Cl.[7] ..... B41J 5/30

(52) U.S. Cl. ..... 400/74; 400/61; 400/70; 400/76

(58) Field of Search ..... 400/74, 61, 70, 400/76; 347/14, 19

(56) References Cited

U.S. PATENT DOCUMENTS

| | | | | |
|---|---|---|---|---|
| 4,313,124 A | | 1/1982 | Hara | 346/140 R |
| 4,345,262 A | | 8/1982 | Shirato et al. | 346/140 R |
| 4,459,600 A | | 7/1984 | Sato et al. | 346/140 R |
| 4,463,359 A | | 7/1984 | Ayata et al. | 346/1.1 |
| 4,558,333 A | | 12/1985 | Sugitoni et al. | 346/107 R |
| 4,723,129 A | | 2/1988 | Endo et al. | 346/1.1 |
| 4,740,796 A | | 4/1988 | Endo et al. | 346/1.1 |
| 5,461,462 A | * | 10/1995 | Nakane et al. | 355/208 |
| 5,526,027 A | * | 6/1996 | Wade et al. | 347/14 |
| 5,856,876 A | * | 1/1999 | Sasanuma et al. | 358/300 |
| 5,997,123 A | * | 12/1999 | Takeskoshi et al. | 347/14 |
| 6,027,201 A | * | 2/2000 | Edge | 347/19 |
| 6,145,951 A | * | 11/2000 | Hayasaki et al. | 347/19 |
| 6,244,682 B1 | * | 6/2001 | Walker et al. | 347/19 |

FOREIGN PATENT DOCUMENTS

| | | | |
|---|---|---|---|
| JP | 59-123670 | | 7/1984 |
| JP | 59-138461 | | 8/1984 |
| JP | 3-208657 A | | 9/1991 |
| JP | 407273980 A | * | 10/1995 |
| JP | 8-230190 A | | 9/1996 |
| JP | 10-67101 A | | 3/1998 |

* cited by examiner

*Primary Examiner*—Charles H. Nolan, Jr.
(74) *Attorney, Agent, or Firm*—Fitzpatrick, Cella, Harper & Scinto

(57) ABSTRACT

A printing apparatus capable of easily setting driving conditions in consideration of conditions on the printing apparatus main body side as well at an arbitrary point of time is disclosed. The printing apparatus including a printhead having a plurality of print elements and a head driver for generating a pulse-like driving signal supplied to the printhead. The apparatus sets driving conditions for a printhead with test patterns obtained by simultaneously driving a predetermined number of print elements of the plurality of print elements are printed on the printing medium while the pulse width of the driving signal is decreased stepwise from a predetermined value. Then, the boundary value of a pulse width with which a print element is not properly driven is obtained from the test patterns, and the pulse width of a driving signal generated by the head driver is controlled on the basis of the boundary value.

19 Claims, 11 Drawing Sheets

PRINTING APPARATUS, DRIVING CONDITION SETTING METHOD FOR PRINTHEAD, AND STORAGE MEDIUM

FIELD OF THE INVENTION

The present invention relates to a printing apparatus, a driving condition setting method for a printhead, and a storage medium and, more particularly, to a printing apparatus including a printhead having a plurality of print elements and a driving means for generating pulse-like driving signals supplied to the printhead, a driving condition setting method for the printhead of the apparatus, and a storage medium.

BACKGROUND OF THE INVENTION

Printing apparatuses such as a printer, copying machine, and facsimile are designed to print images made up of dot patterns on printing media (printing sheets) such as paper sheets and thin plastic sheets on the basis of image information.

The printing apparatuses can be classified into ink-jet printers, wire dot printers, thermal printers, laser beam printers, and the like according to the printing schemes. Recently, many printing apparatuses have been used and required to realize, for example, high-speed, high-resolution, high-image-quality, and low-noise printing.

As a printing apparatus that can meet such requirements, an ink-jet printing apparatus is available. This ink-jet printing apparatus is designed to discharge/eject ink (printing liquid) droplets from orifices of the printhead and make the droplets adhere to a printing medium, thereby printing images. This makes it possible to perform noncontact printing. Therefore, stable images can be formed on a variety of media.

Of such ink-jet printing apparatuses, a printer using a method of printing images by forming liquid droplets using heat energy has a simple structure, and hence allows nozzles to be easily arranged at a high density.

According to the operation principle of the ink-jet printing apparatus using heat energy, a pulse-like current is supplied to a heater, the ink is made to locally boil (foam) by the generated heat, and the ink is ejected from a nozzle by a shock wave produced by abrupt volume expansion at the time of evaporation of the ink.

Although this method allows a simple structure, since the heaters are in direct contact with ink, scorched ink adheres (kogation) to the heater surfaces, causing several problems. For example, uniformity on the heater surfaces is impaired, uniformity of foaming is also impaired, resulting in disturbance of the discharge direction (misdirection) and a decrease in heat conductivity with respect to the ink, which in turn cause a decrease in ink discharge amount (poor discharge) due to insufficient foaming. In general, to prevent this poor discharge, each heater is driven with a driving pulse width being set to necessary minimum $+\alpha$. If, however, the value of "$+\alpha$" is too large, the temperature of the heater rises too much, promoting kogation.

As methods of determining a proper driving pulse width, a method of ranking the resistance value of the heaters and a method of storing driving conditions in a printhead have been proposed.

In addition, as the density and number of nozzles increase, voltage variations due to changes in the number of nozzles driven at once cannot be neglected. In the past, driving pulses that allow sufficient ink discharge even at a drop in voltage were used. In this method, however, as the number of nozzles driven at once increases and a significant voltage drop occurs, excessive energy is applied to the heaters when the voltage does not drop too much. For this reason, a method of changing the pulse width depending on the magnitude of voltage drop has been proposed.

As described above, "misdirection", "kogation", and the like occur in the ink-jet printing apparatus unless proper driving conditions are set. Such faults become big factors that impair the durability of the printhead.

According to the conventional driving condition setting method, however, driving conditions are set in consideration of only conditions on the printhead side, and no consideration is given to variations and the like on the printer main body side. Furthermore, the driving conditions for the printhead change with time due to the influences of kogation and the like, but no consideration has been given to such secular changes.

SUMMARY OF THE INVENTION

It is the first object of the present invention to provide a printing apparatus which can easily set driving conditions in consideration of conditions on the printing apparatus main body side as well as at an arbitrary point of time.

It is the second object of the present invention to provide a driving condition setting method for a printhead which can easily set driving conditions in consideration of conditions on the printing apparatus main body side as well as at an arbitrary point of time, and a storage medium storing the method.

In order to achieve the first object, according to the present invention, there is provided a printing apparatus for performing printing on a printing medium by a printhead having a plurality of print elements, comprising driving means for generating a pulse-like driving signal supplied to the printhead, test pattern printing means for printing test patterns obtained by simultaneously driving a predetermined number of print elements of the plurality of print elements on the printing medium while a pulse width of the driving signal is decreased stepwise from a predetermined value, and control means for controlling a pulse width of a driving signal generated by the driving means on the basis of a boundary value of a pulse width with which a print element is not properly driven obtained from the test patterns.

In order to achieve the second object, according to the present invention, there is provided a driving condition setting method for a printhead in a printing apparatus including a printhead having a plurality of print elements and driving means for generating a pulse-like driving signal supplied to the printhead, comprising the test pattern printing step of printing test patterns obtained by simultaneously driving a predetermined number of print elements of the plurality of print elements on the printing medium while a pulse width of the driving signal is decreased stepwise from a predetermined value, and the control step of controlling a pulse width of a driving signal generated by the driving means on the basis of a boundary value of a pulse width with which a print element is not properly driven obtained from the test patterns.

The second object can also be achieved by a storage medium storing a program implementing the above method.

More specifically, according to the present invention, when driving conditions for a printhead are set in a printing apparatus including a printhead having a plurality of print elements and driving means for generating a pulse-like driving signal supplied to the printhead, test patterns obtained by simultaneously driving a predetermined number of print elements of the plurality of print elements are printed on the printing medium while the pulse width of the driving signal is decreased stepwise from a predetermined value, the boundary value of a pulse width with which a print element is not properly driven is obtained from the test patterns, and the pulse width of a driving signal generated by the driving means is controlled on the basis of the boundary value.

According to this method, driving conditions for the printhead can therefore be set at an arbitrary point of time in consideration of variations in conditions (power supply capacity and power line resistance) on the printer main body side as well as variations in conditions for the printhead (e.g., heater resistance, the ON resistance of each heater driving element, head wiring resistance, and heater thermal efficiency). This makes it possible to improve discharge stability and durability.

If the printhead includes a storage means for storing information about the characteristics of the print elements, a boundary value can be derived more quickly by making the test pattern printing means read out information from the storage means and determine a range in which the pulse width of the driving signal changes.

The control means preferably calculates the pulse width of a driving signal, from the boundary value, in a case where the number of print elements simultaneously driven differs from a predetermined number.

The test pattern printing means preferably prints a plurality of test patterns by changing the predetermined number.

The control means is preferably configured to calculate the pulse width of a driving signal by performing a predetermined computation for the boundary value.

The test pattern printing means preferably prints patterns while decreasing the amplitude of a driving signal at a predetermined rate, and the control means preferably controls the pulse width of a driving signal to the boundary value.

The test pattern printing means preferably includes storage means for storing information used to print test patterns.

The deriving means preferably includes a density sensor for detecting the density of a test pattern and obtains a boundary value from a change in detected density.

Other features and advantages of the present invention will be apparent from the following description taken in conjunction with the accompanying drawings, in which like reference characters designate the same or similar throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

In this specification, "print" is not only to form significant information such as characters and graphics but also to form, e.g., images, figures, and patterns on printing media in a broad sense, regardless of whether the information formed is significant or insignificant or whether the information formed is visualized so that a human can visually perceive it, or to process printing media.

"Printing media" are any media capable of receiving ink, such as cloth, plastic films, metal plates, glass, ceramics, wood, and leather, as well as paper sheets used in common printing apparatuses.

Furthermore, "ink" (to be also referred to as a "liquid" hereinafter) should be broadly interpreted like the definition of "print" described above. That is, ink is a liquid which is applied onto a printing medium and thereby can be used to form images, figures, and patterns, to process the printing medium, or to process ink (e.g., to solidify or insolubilize a colorant in ink applied to a printing medium).

At first, general structure of an inkjet printer according to the present invention will be described.

<Apparatus Main Body>

Figure 9:
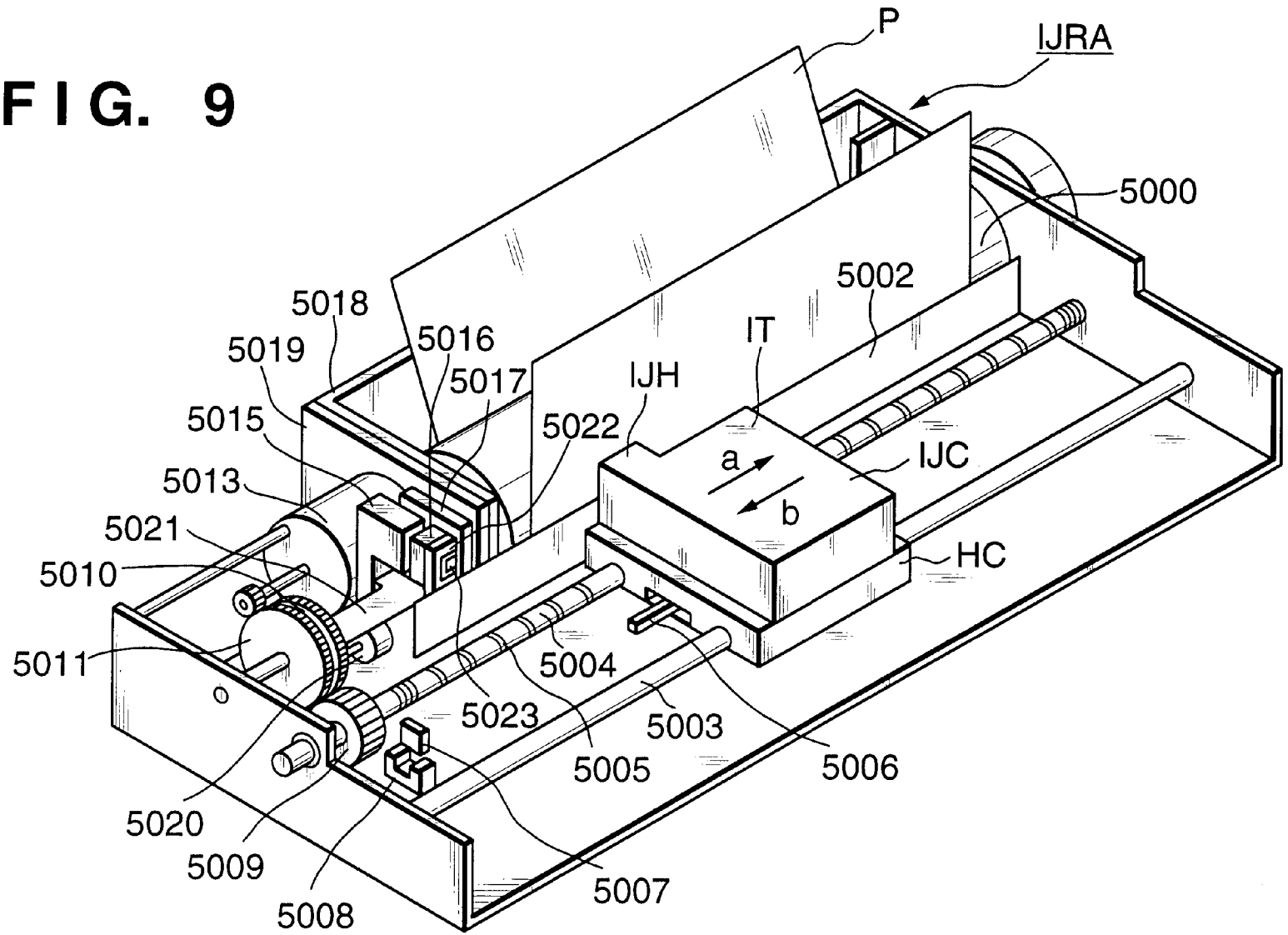
FIG. 9 is a perspective view showing the outer appearance of an ink-jet printer to which the present invention is applied.

FIG. 9 is a perspective view showing an outer appearance of the construction of an ink-jet printer IJRA as a typical embodiment of the present invention. Referring to FIG. 9, a carriage HC engages with a spiral groove 5004 of a lead screw 5005, which rotates via driving force transmission gears 5009 to 5011 upon forward/reverse rotation of a driving motor 5013. The carriage HC has a pin (not shown), and is reciprocally scanned in the directions of arrows a and b while being supported by a guide rail 5003. An integrated ink cartridge IJC, incorporating a printhead IJH and an ink tank IT, is mounted on the carriage HC.

In the described structure, the number of inkjet cartridge IJC mounted on the carriage HC is one, however, when a color printing is performed, a plurality of inkjet cartridges for respective colors of CMYK are mounted on the carriage HC, or an inkjet cartridge IJC is made to have one inkjet printhead which discharges ink from divided areas for ink supplied from ink tanks IT containing respective ink of colors.

Reference numeral 5002 denotes a sheet pressing plate, which presses a paper sheet P against a platen 5000, ranging from one end to the other end of the scanning path of the carriage HC. Reference numerals 5007 and 5008 denote photocouplers which serve as a home position detector for recognizing the presence of a lever 5006 of the carriage in a corresponding region, and are used for switching, e.g., the rotating direction of the motor 5013.

Reference numeral 5016 denotes a member for supporting a cap member 5022, which caps the front surface of the printhead IJH; and 5015, a suction device for sucking ink residue inside the cap member. The suction device 5015 performs suction recovery of the printhead through an opening 5023 of the cap member 5015. Reference numeral 5017 denotes a cleaning blade; 5019, a member which allows the blade to be movable in the back-and-forth direction of the blade. These members are supported on a main unit support plate 5018. The shape of the blade is not limited to this, but a known cleaning blade can be used in this embodiment.

Reference numeral 5021 denotes a lever for initiating a suction operation in the suction recovery operation. The lever 5021 moves upon movement of a cam 5020, which engages with the carriage, and receives a driving force from the driving motor via a known transmission mechanism such as clutch switching.

The capping, cleaning, and suction recovery operations are performed at their corresponding positions upon operation of the lead screw 5005 when the carriage reaches the home-position side region. However, the present invention is not limited to this arrangement as long as desired operations are performed at known timings.

<Control Circuit>

Next, description will be provided on the control circuit for executing print control of the above-described printing apparatus.

Figure 10:
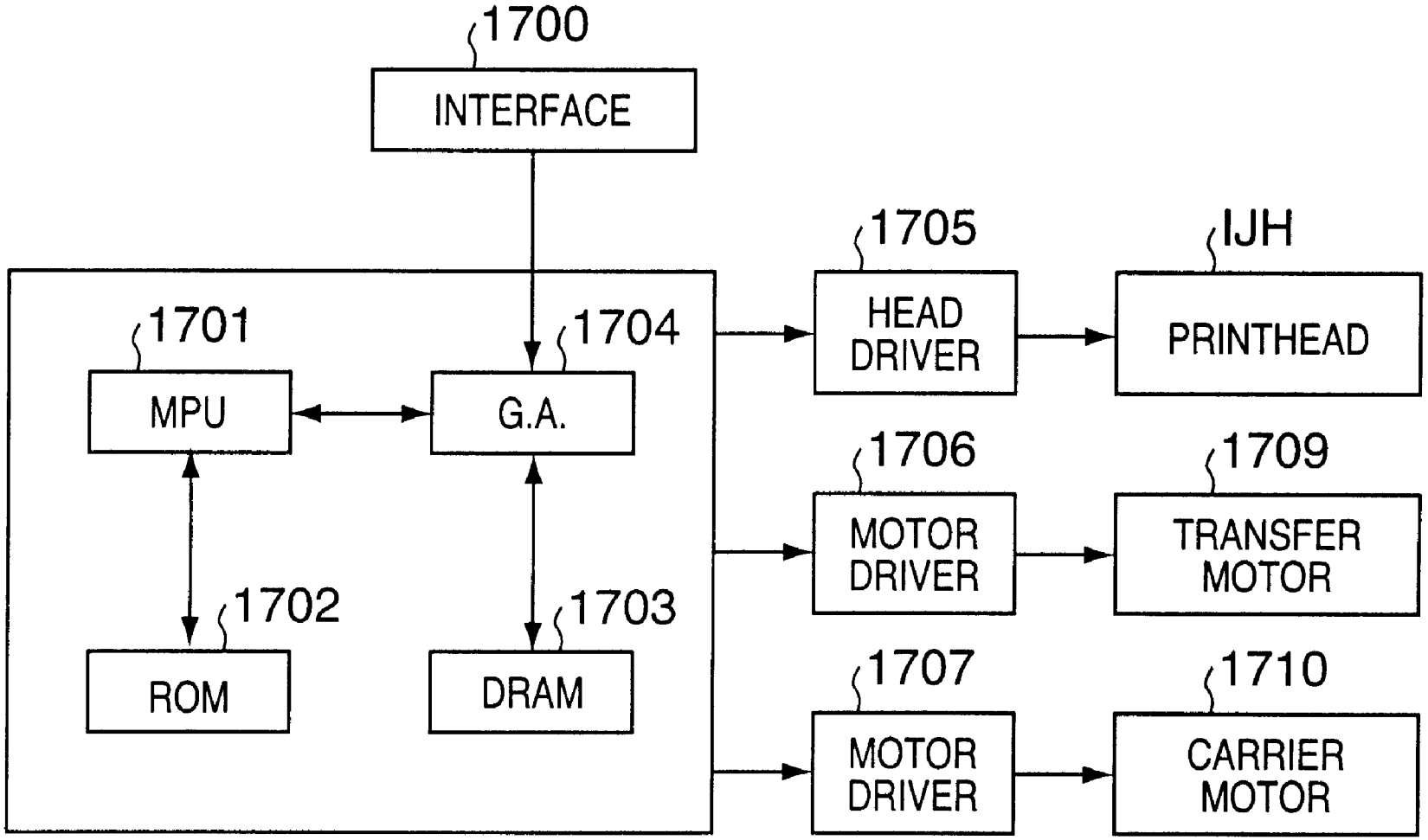
FIG. 10 is a block diagram showing the control arrangement of the printer in FIG. 9.

FIG. 10 is a block diagram showing an arrangement of a control circuit of the ink-jet printer IJRA. Referring to FIG. 10 showing the control circuit, reference numeral 1700 denotes an interface for inputting a print signal; 1701, an MPU; 1702, ROM for storing a control program executed by the MPU 1701; and 1703, DRAM for storing various data (aforementioned print signals, or print data supplied to the printhead IJH, and the like). Reference numeral 1704 denotes a gate array (G.A.) for controlling the supply of print data to the printhead IJH. The gate array 1704 also performs data transfer control among the interface 1700, the MPU 1701, and the DRAM 1703. Reference numeral 1710 denotes a carrier motor for conveying the printhead IJH; and 1709, a transfer motor for transferring a print medium. Reference numeral 1705 denotes a head driver for driving the printhead IJH; and 1706 and 1707, motor drivers for driving the transfer motor 1709 and the carrier motor 1710 respectively.

The operation of the aforementioned control structure is now described. When a print signal is inputted to the interface 1700, the print signal is converted to print data by the gate array 1704 and MPU 1701 intercommunicating with each other. As the motor drivers 1706 and 1707 are driven, the printhead IJH is driven in accordance with the print data transferred to the head driver 1705, thereby performing printing.

In this case, the control program executed by the MPU 1701 is stored in the ROM 1702, it is also possible to add an erasable/writable storage medium such as an EEPROM, and to change the control program stored therein from the host computer connected to the ink-jet printer IJRA.

<Ink Cartridge>

Note that the ink tank IT and printhead IJH may be integrally structured to constitute the exchangeable ink cartridge IJC as described above, or may be configured separately so as to allow exchange of only the ink tank IT when ink is exhausted.

Figure 11:
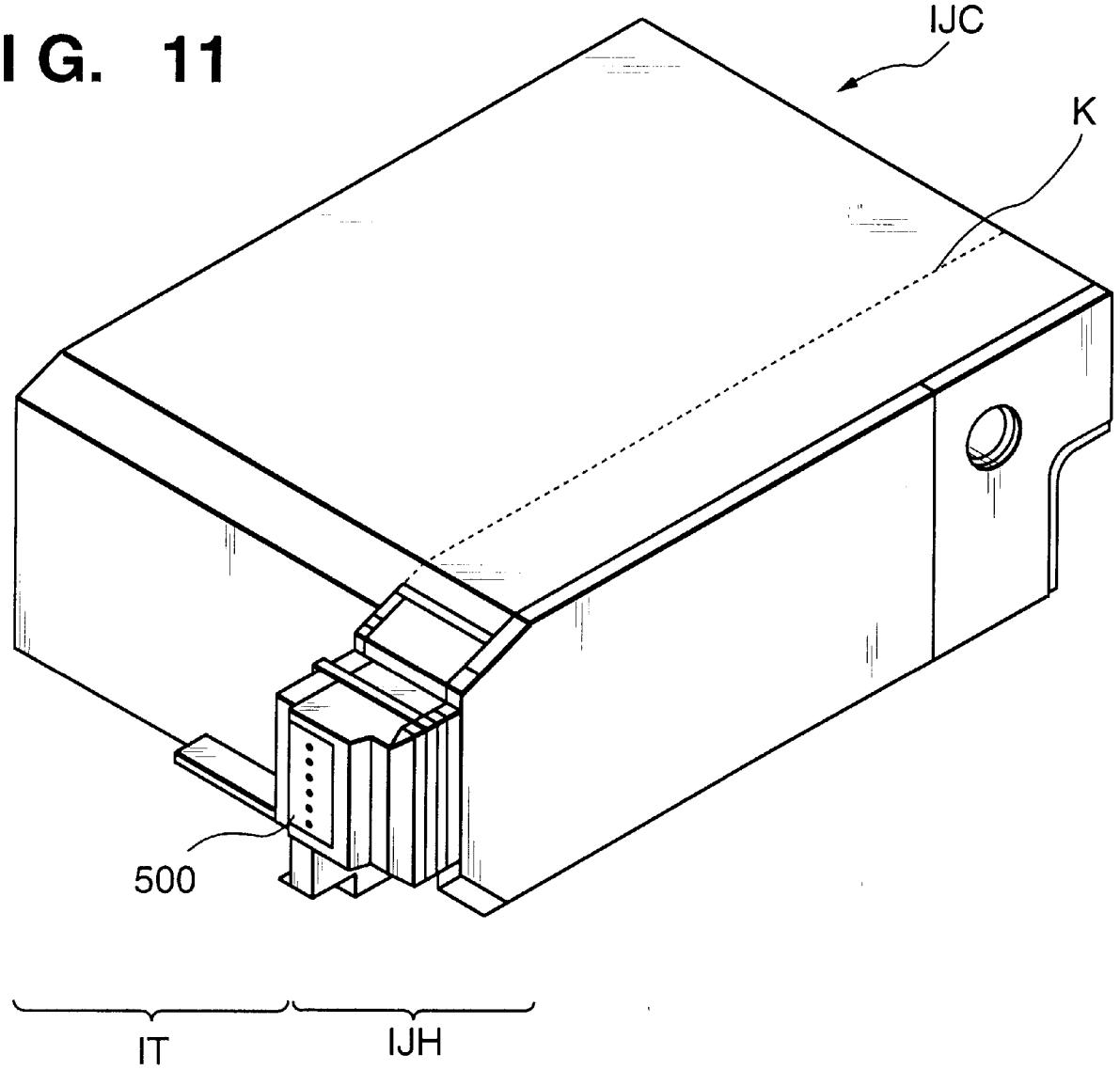
FIG. 11 is a perspective view showing an ink-jet cartridge in the printer in FIG. 9.

FIG. 11 is a perspective view showing an outer appearance of the ink cartridge IJC where the printhead IJH and ink tank IT are separable. In the ink cartridge IJC shown in FIG. 11, the printhead IJH can be separated from the ink tank IT at the boundary line K. The ink cartridge IJC includes an electrical contact portion (not shown) so that the ink cartridge IJC receives electrical signals from the carriage HC when mounted on the carriage HC. The printhead IJH is driven by the received electrical signals as described before.

Note in FIG. 11, reference numeral 500 denotes an array of ink discharge orifices. The ink tank IT includes a fibrous or porous ink absorbing member for maintaining ink. Each nozzle has a heating element such as a heater which is an electrothermal transducer. When a driving pulse from the printer main body is applied to the nozzle, the ink in the nozzle is made to boil (foam), and the ink is ejected from the nozzle by a shock wave produced by abrupt volume expansion at the time of evaporation of the ink.

Several embodiments to which the present invention is applied to the above ink-jet printer will be described below.

[First Embodiment]

In the first embodiment, the printer has a driving condition setting mode as an operation mode independently of a normal printing mode. A shift to this driving condition setting mode is made by a switch provided on the printer itself or an instruction through a user interface on an external device serving as a host. In this driving condition setting mode, actual printing operation is performed while the pulse width of a driving signal is decreased stepwise, the limit of the pulse width with which ink is discharged is obtained from the mounted printhead, and a driving pulse is set with reference to the obtained value.

Figure 5:
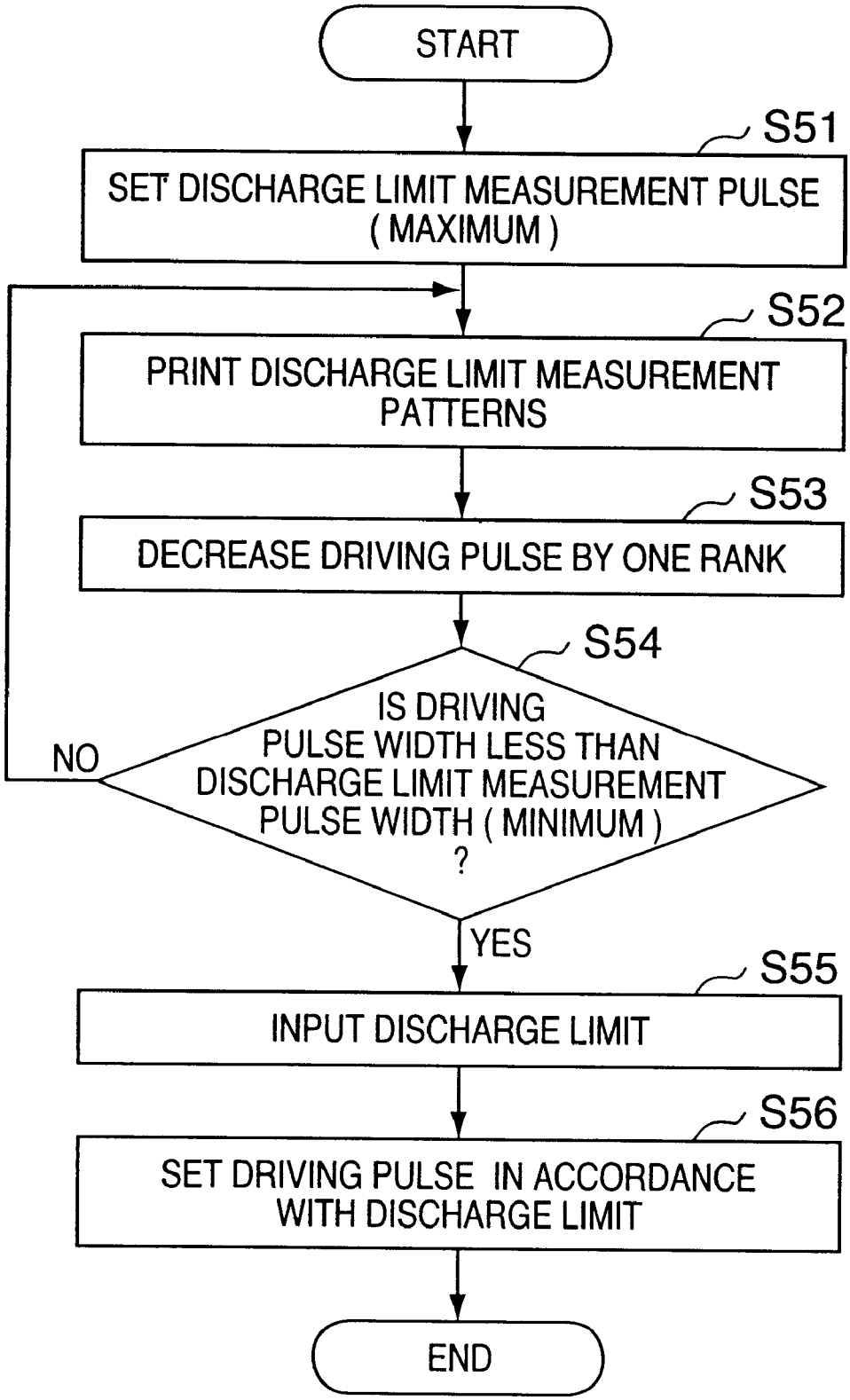
FIG. 5 is flow chart showing processing in the first embodiment of the present invention.

The operation of this embodiment will be described with reference to the flow chart of FIG. 5.

First of all, the maximum and minimum design values of the width of a driving pulse are obtained from the type of printhead mounted, and the driving pulse width is set to the maximum design value (the maximum value of a discharge limit measurement pulse; Pth_max) of the width driving pulse width (step S51). If a plurality of types of printheads can be mounted on the printer, the types of printheads and the maximum and minimum design values of driving pulse widths may be stored in the form of a table in an ROM 1702 or the like in the printer main body.

The printhead is then driven by using the set pulse to print discharge limit measurement patterns on a printing medium (step S52). In this embodiment, as these measurement patterns, patterns obtained by simultaneously driving a predetermined number of nozzles are used. If the number of nozzles simultaneously driven (the number of droplets simultaneously discharged) is set to about ½ the maximum number of nozzles that can be simultaneously driven, the number of nozzles simultaneously driven can be easily estimated even when it changes.

The driving pulse width is decreased by one rank corresponding to a predetermined amount (step S53), and it is checked whether the driving pulse width becomes less than the minimum design value (the minimum value of the discharge limit measurement pulse; Pth_min) (step S54).

The processing from step S52 to step S54 is repeated until the driving pulse width becomes less than the minimum design value of the discharge limit measurement pulse. When the driving pulse width becomes less than the minimum design value of the discharge limit measurement pulse, the printing operation is terminated.

Table 1 shows an example of driving pulse setting in this embodiment. In this case, the numbers of nozzles simultaneously driven were classified into 12 levels (the number of simultaneous discharge ranks: 12), and patterns were printed at the sixth level (simultaneous discharge rank 6) while pulse widths were classified into eight levels (the number of pulse width ranks: 8).

TABLE 1

| Simultaneous Discharge Rank | Display | Pth(n) [μs] 1 | 2 | 3 | 4 | 5 | 6 | 7 | 8 |
|---|---|---|---|---|---|---|---|---|---|
| 6 | F | 0.35 | 0.30 | 0.25 | 0.20 | 0.15 | 0.10 | 0.05 | 0.00 |

Figure 4:
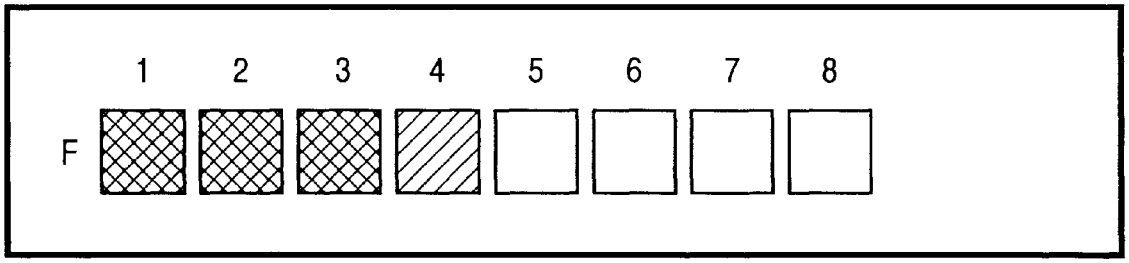
FIG. 4 is a view showing print samples of driving limit measurement patterns in the first embodiment of the present invention.

The values shown in the table are the relative differences between the pulse widths in the respective ranks and the pulse width in rank 8 exhibiting the minimum pulse width. That is, the pulse width in rank 7 is longer than that in rank 8, which exhibits the minimum pulse width, by 0.05 μsec, and the pulse width in rank 1 is longer than that in rank 8 by 0.35 μsec. FIG. 4 shows the printing results of the discharge limit measurement patterns actually printed according to this table.

Identification symbols such as numbers for identifying the respective pulse widths with which the respective discharge limit measurement patterns are printed are preferably printed together with the patterns. In addition, the driving pulses used when these identification symbols are printed are preferably set to Pth_ma+α or more to allow any type of head to print them. In this case, the printing sequence is set from Pth_max to Pth_min for the following reason. The ink in each nozzle increases its viscosity due to drying and the like if no ink is discharged for a certain period of time. For this reason, a driving pulse larger than actually necessary is required. After the above printing operation is performed, therefore, pre-discharge or preparatory printing is preferably performed sufficiently.

An identification symbol corresponding to a pattern in which "fading" indicating an ink discharge failure is read from the printing results, and the corresponding value (rank number) is input as a discharge limit to the printer main body through a user interface or the like on an external device serving as a host (step S55). For example, according to the printing results in FIG. 4, "fading" is visually recognized from the pattern indicated by 4. The printer main body sets an optimal driving pulse width by performing a predetermined computation for the pulse width corresponding to this value (step S56).

In addition, the printer main body classifies the numbers of nozzles simultaneously driven into a plurality of levels, and sets driving pulses corresponding to the respective levels from the set driving pulses. Table 2 shows an example of the correspondence between the rank numbers selected in step S55 and the pulse widths in other simultaneous discharge ranks.

TABLE 2

| | | No. Selected in Rank 6 (Display F) 1 | 2 | 3 | 4 | 5 | 6 | 7 | 8 |
|---|---|---|---|---|---|---|---|---|---|
| Simultaneous Discharge | 1 | 0.00 | 0.00 | 0.00 | 0.00 | 0.00 | 0.00 | 0.00 | 0.00 |
| | 2 | 0.10 | 0.05 | 0.05 | 0.05 | 0.05 | 0.00 | 0.00 | 0.00 |
| | 3 | 0.15 | 0.10 | 0.10 | 0.01 | 0.05 | 0.05 | 0.00 | 0.00 |
| | 4 | 0.20 | 0.20 | 0.15 | 0.01 | 0.10 | 0.05 | 0.00 | 0.00 |

TABLE 2-continued

| | | No. Selected in Rank 6 (Display F) 1 | 2 | 3 | 4 | 5 | 6 | 7 | 8 |
|---|---|---|---|---|---|---|---|---|---|
| Rank | 5 | 0.30 | 0.25 | 0.20 | 0.15 | 0.10 | 0.10 | 0.05 | 0.00 |
| | 6 | 0.35 | 0.30 | 0.25 | 0.20 | 0.15 | 0.10 | 0.05 | 0.00 |
| | 7 | 0.40 | 0.35 | 0.30 | 0.20 | 0.15 | 0.10 | 0.05 | 0.05 |
| | 8 | 0.45 | 0.40 | 0.30 | 0.20 | 0.15 | 0.15 | 0.05 | 0.05 |
| | 9 | 0.50 | 0.45 | 0.35 | 0.25 | 0.20 | 0.15 | 0.10 | 0.05 |
| | 10 | 0.50 | 0.50 | 0.40 | 0.25 | 0.20 | 0.15 | 0.10 | 0.05 |
| | 11 | 0.55 | 0.55 | 0.45 | 0.30 | 0.20 | 0.20 | 0.10 | 0.05 |
| | 12 | 0.60 | 0.55 | 0.50 | 0.30 | 0.25 | 0.20 | 0.10 | 0.05 |

Pth(n) [μs]

If, for example, pulse width rank 5 is selected upon execution of printing in simultaneous discharge rank 6, the driving pulse corresponding to simultaneous discharge rank 1 is decreased by the value "0.15 (μsec)" obtained by subtracting the value "0.00" in simultaneous discharge rank 1 from the value "0.15" in simultaneous discharge rank 5 in pulse width rank 5. On the other hand, the driving pulse corresponding to simultaneous discharge rank 12 is increased by 0.15 (μsec) because the difference between the two values is "−0.15". These set values are preferably stored in the form of a table in the ROM 1702 or the like.

As described above, according to this embodiment, actual printing is performed by using the printhead mounted on the printer while the number of nozzles simultaneously driven is set to a predetermined value, and only the driving pulse width is changed, and the width of a driving pulse used for printing is determined on the basis of the printing results.

Driving conditions for the printhead can therefore be set at an arbitrary point of time in consideration of variations in conditions (power supply capacity and power line resistance) on the printer main body side as well as variations in conditions for the printhead (e.g., heater resistance, the ON resistance of each heater driving element, head wiring resistance, and heater thermal efficiency). This makes it possible to improve discharge stability and durability.

[Second Embodiment]

In the first embodiment, the maximum and minimum design values of the width of a driving pulse is obtained from the type of single printhead mounted on the printer, and actual printing is performed while the number of nozzles simultaneously driven is set to a predetermined value, and only the driving pulse width is changed, thereby determining the width of a driving pulse used for printing on the basis of the printing results. According to the second embodiment, in a printer or the like which has a plurality of printheads for respectively discharging inks of different colors, information stored in each printhead is read out, and discharge limit measurement patterns are printed in each color in order to make more proper driving pulse setting.

Figure 6:
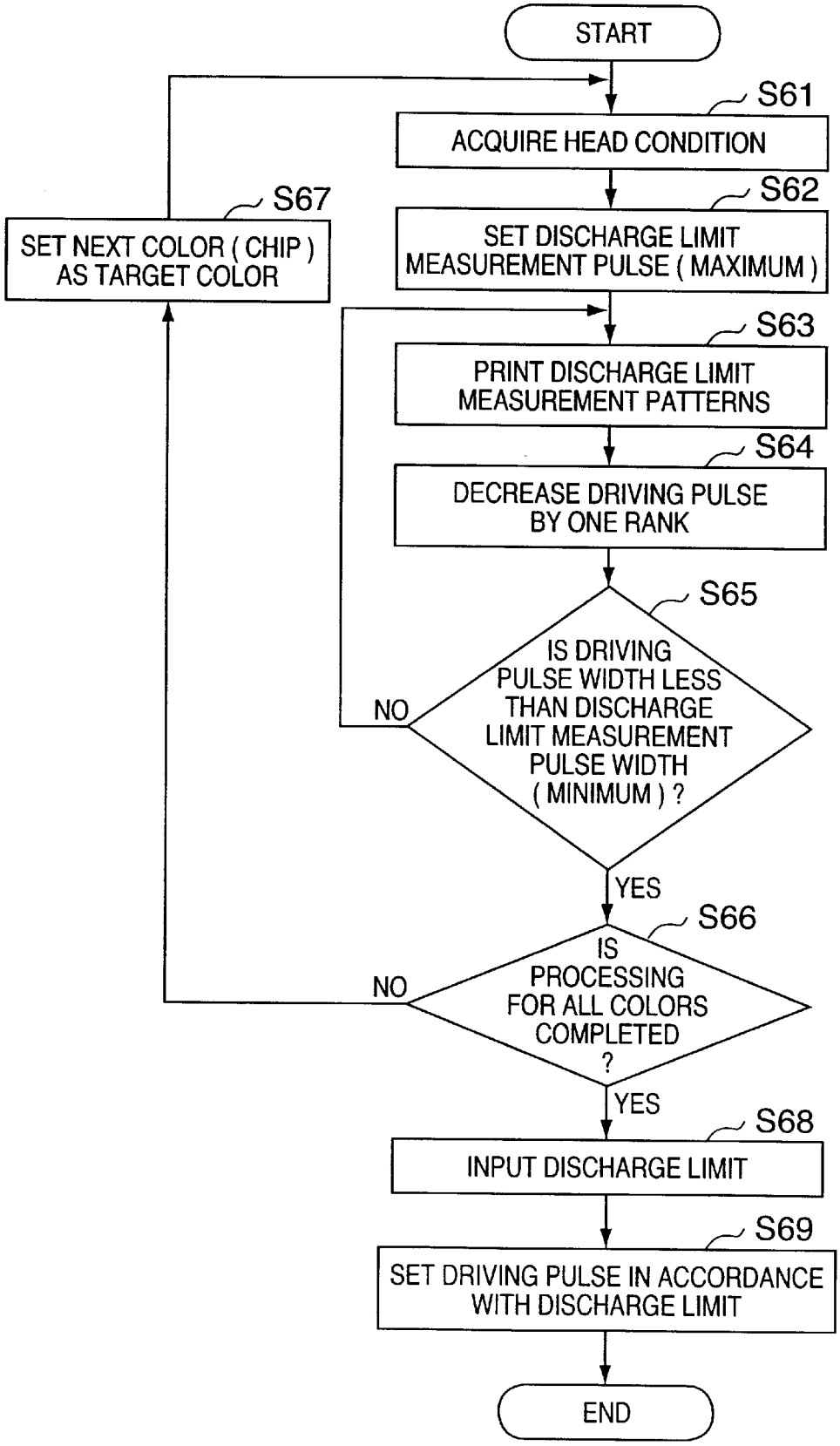
FIG. 6 is flow chart showing processing in the second embodiment of the present invention.

This embodiment will be described with reference to the flow chart of FIG. 6, with particular emphasis on the differences between the first and second embodiments. Assume that in this case, a driving voltage Vh and inks of six colors (C, M, Y, K, Lc (light cyan), and Lm (light magenta)) are used, and 256 nozzles of each printhead are grouped into 16 blocks to be time-divisionally driven.

First of all, pieces of information such as a heater rank and the ON resistance rank of a driving transistor are read out from each printhead (step S61). Assume that these pieces of information are written in a storage element such as an EEPROM in each printhead at the time of shipment.

A pulse width (Pth_center) set as a median value of measurement is obtained according to Table 3 given below.

Table 3 shows an example of a table for obtaining Pth_center from a heater rank and the ON resistance rank of a transistor.

TABLE 3

| | | $Pth_{13}$center [μs] | | | | |
|---|---|---|---|---|---|---|
| | | TrON Rank | | | | |
| | | 1 | 2 | 3 | 4 | 5 |
| Heater Rank | 1 | 1.00 | 1.05 | 1.10 | 1.15 | 1.20 |
| | 2 | 1.05 | 1.10 | 1.15 | 1.20 | 1.25 |
| | 3 | 1.10 | 1.15 | 1.20 | 1.25 | 1.30 |
| | 4 | 1.15 | 1.20 | 1.25 | 1.30 | 1.35 |
| | 5 | 1.20 | 1.25 | 1.30 | 1.35 | 1.40 |

The minimum value (Pth_min) and maximum value (Pth_max) of a driving measurement pulse corresponding to the obtained value of Pth_center are obtained from Table 4 given below, and the driving pulse width is set to the maximum value of the discharge limit measurement pulse: Pth_max (step S62). Note that these two tables may be stored in a ROM 1702 or the like of the printer main body.

TABLE 4

| Identification Symbol | Pth Measurement Driving Pulse | |
|---|---|---|
| 9 | Pth center − 0.20 | Pth min |
| 8 | Pth center − 0.15 | |
| 7 | Pth center − 0.10 | |
| 6 | Pth center − 0.05 | |
| 5 | Pth center | |
| 4 | Pth center + 0.05 | |
| 3 | Pth center + 0.10 | |
| 2 | Pth center + 0.15 | |
| 1 | Pth center + 0.20 | Pth max |

The printhead is then driven by using the set pulse to print discharge limit measurement patterns on a printing medium (step S63). In this embodiment, as these discharge limit measurement patterns, patterns obtained by simultaneously driving a predetermined number of nozzles in each block are used. These patterns may also be stored in the ROM 1702 or the like. If the number of nozzles simultaneously driven (the number of droplets simultaneously discharged) is set to about ½ the maximum number of nozzles that can be simultaneously driven, the number of nozzles simultaneously driven can be easily estimated even when it changes.

The driving pulse width is decreased by one rank corresponding to a predetermined amount (step S64), and it is checked whether the driving pulse width becomes less than the minimum value of the discharge limit measurement pulse: Pth_min (step S65).

The processing from step S63 to step S65 is repeated until the driving pulse width becomes less than the minimum value of the discharge limit measurement pulse. When the driving pulse width becomes less than the minimum value of the discharge limit measurement pulse, the printing of the driving limit measurement patterns corresponding to one color is terminated. In this case, as indicated by Table 4, patterns are printed with pulse widths classified into nine levels (the number of pulse width ranks: 9).

Figure 1:
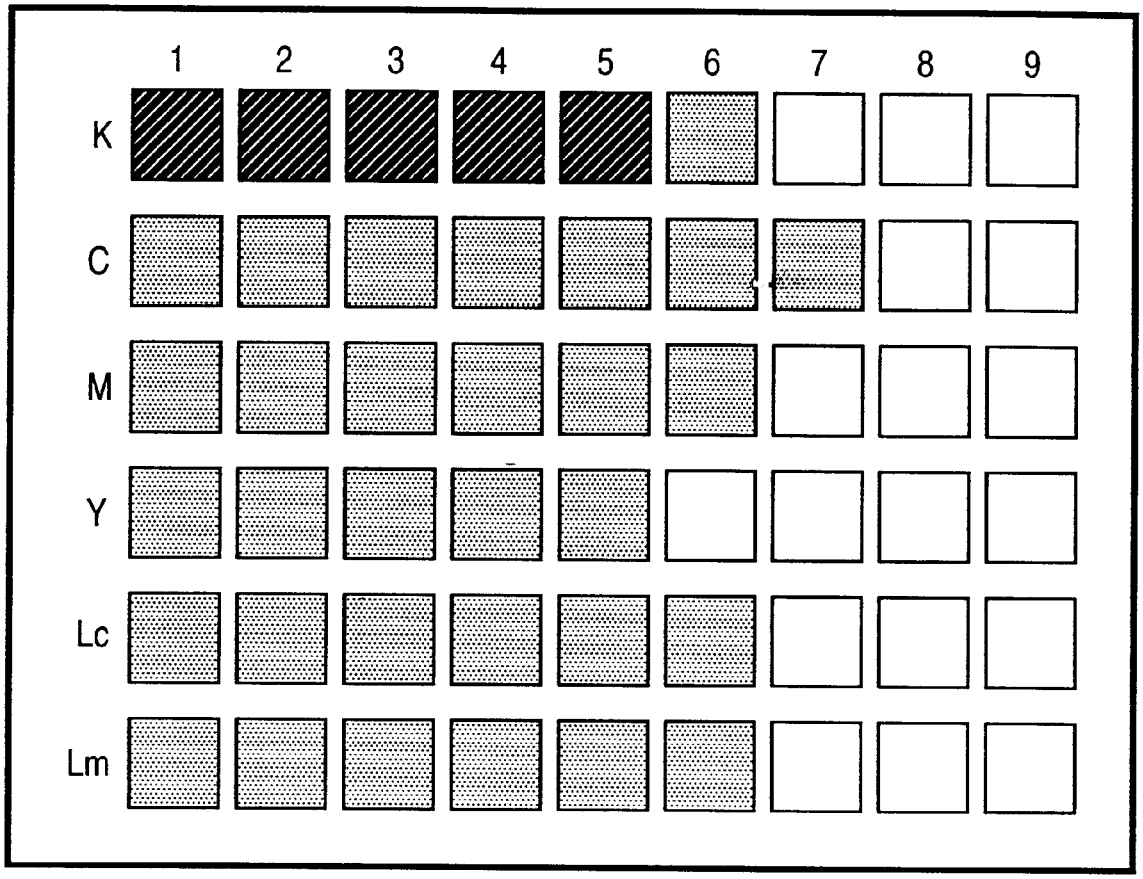
FIG. 1 is a view showing print samples of driving limit measurement patterns in the second embodiment of the present invention.

It is checked whether processing for all the colors (inks) is completed (step S66). If the processing is not completed, the next color is set as a target color (step S67), and the flow returns to step S61. In this embodiment, driving limit measurement patterns are printed in units of inks (printheads) assuming that driving conditions change depending on the respective inks, printheads, and printhead chips. FIG. 1 shows the printing results of discharge limit measurement patterns printed in this embodiment.

An identification symbol corresponding to a pattern in which "fading" indicating each ink discharge failure is read from the printing results, and the corresponding value (rank number) is input as a discharge limit to the printer main body through a user interface or the like on an external device serving as a host (step S68). For example, according to the printing results in FIG. 1, "fading" is visually recognized from the pattern indicated by the symbol "7" for ink K; and the pattern indicated by the symbol "8" for ink C. The printer main body sets optimal driving pulse widths by performing predetermined computation for the pulse widths corresponding to these symbols (step S69).

If, for example, the pulse width with which fading is recognized is Pth, a driving pulse width Pop is set as Pth×A (A: constant of about 1.2 to 1.7). In this case, since the calculated value rarely becomes an integer multiple of the minimum resolution of a pulse, a table indicating the correspondence between Pth and Pop may be prepared to directly obtain Pop from the value of Pth more easily. Table 5 shows an example of a table indicating the correspondence between Pth and Pop for A=1.45.

TABLE 5

| A = 1.45 | |
|---|---|
| Pth | Pop |
| 0.80 | 1.15 |
| 0.85 | 1.25 |
| 0.90 | 1.30 |
| 0.95 | 1.40 |
| 1.00 | 1.45 |
| 1.05 | 1.50 |
| 1.10 | 1.60 |
| 1.15 | 1.65 |
| 1.20 | 1.75 |
| 1.25 | 1.80 |
| 1.30 | 1.90 |
| 1.35 | 1.95 |
| 1.40 | 2.05 |
| 1.45 | 2.10 |
| 1.50 | 2.15 |
| 1.55 | 2.25 |
| 1.60 | 2.30 |

As in the first embodiment, the printer main body classifies the numbers of nozzles simultaneously driven into a plurality of levels, and sets driving pulses corresponding to the respective levels from the set driving pulses.

As described above, in this embodiment, actual printing performed for each ink while the driving pulse width is changed in a predetermined range on the basis of information from the corresponding printhead mounted on the printer, and the width of a driving pulse used for printing is determined for each ink on the basis of the printing result.

Driving conditions for each printhead can therefore be set more finely in consideration of variations in conditions (power supply capacity and power line resistance) on the printer main body side as well as variations in conditions for the printhead (e.g., heater resistance, the ON resistance of each heater driving element, head wiring resistance, and heater thermal efficiency). This makes it possible to improve discharge stability and durability.

[Third Embodiment]

In the first and second embodiments, discharge limit measurement patterns are printed while the number of nozzles simultaneously driven is set to a predetermined value, and only the driving pulse width is changed. In this third embodiment, discharge limit measurement patterns are printed while the driving pulse width and the number of nozzles simultaneously driven are changed at once.

Figure 7:
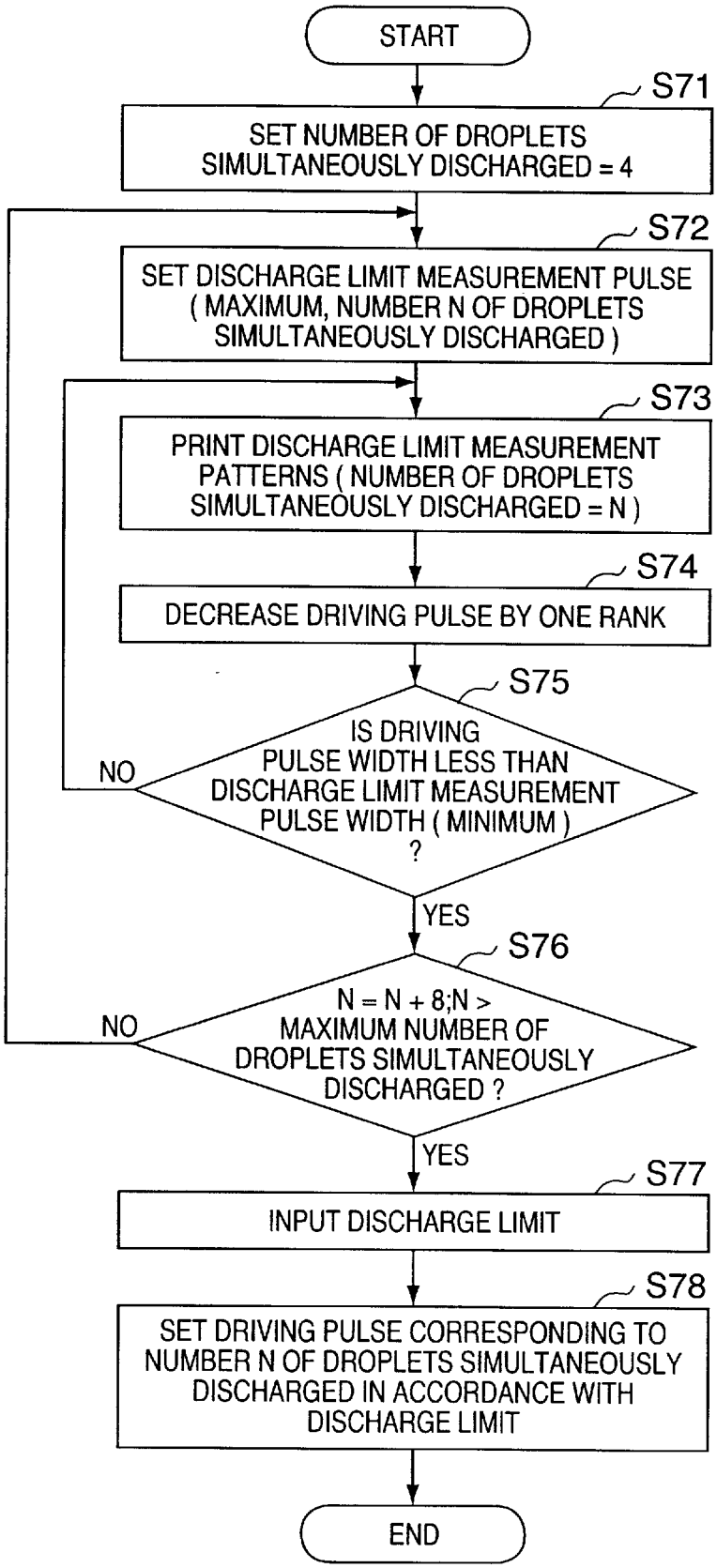
FIG. 7 is flow chart showing processing in the third embodiment of the present invention.

This embodiment will be described below with reference to the flow chart of FIG. 7 with particular emphasis on the points different from the first and second embodiments. Assume that in this case, a driving voltage Vh and inks of six colors (C, M, Y, K, Lc (light cyan), and Lm (light magenta)) are used, and 256 nozzles of each printhead are grouped into 16 blocks to be time-divisionally driven.

With the 16 blocks, the number of nozzles simultaneously driven changes from 0 to 96. For example, the numbers of nozzles simultaneously driven are classified in units of eight nozzles such that the numbers of droplets simultaneously discharged, 0 to 7, are set to rank 1; 8 to 15, to rank 2, . . . ,; 88 to 96, to rank 12. Representative values in the respective ranks are then determined; 4 for rank 1, 12 for rank 2, and the like. Patterns obtained by simultaneously driving nozzles corresponding to each of these values are stored in a ROM in the main body in advance. In these patterns, the numbers of droplets simultaneously discharged are preferably distributed as evenly as possible for the respective colors (the respective power feed lines) (if, for example, the number of droplets simultaneously discharged is 36, "six for the respective colors" is prefer to "16 for two colors+four for one color").

First of all, a number N of droplets simultaneously discharged is set to the minimum value (N=4) (step S71), and the maximum value of the discharge limit measurement patterns is set as a driving pulse as in the above embodiment (step S72).

The printhead is then driven by using the set pulse to print discharge limit measurement patterns on a printing medium (step S73). The driving pulse width is decreased by one rank corresponding to a predetermined amount (step S74), and it is checked whether the driving pulse width becomes less than the minimum value of the discharge limit measurement pulse; Pth_min (step S75).

The processing from step S73 to step S75 is repeated until the driving pulse width becomes less than the minimum value of the discharge limit measurement pulse. When the driving pulse width becomes less than the minimum value of the discharge limit measurement pulse, the printing of the driving limit measurement patterns corresponding to the set number of droplets simultaneously discharged is terminated. In this case, each pattern is printed while pulse widths are classified into 10 levels (the number of pulse width ranks: 10).

Subsequently, the number N of droplets simultaneously discharged is increased by eight, and it is checked whether the resultant value exceeds the maximum number of droplets simultaneously discharged (96) (step S76). If the number N does not exceed it, the flow returns to step S72 to repeat the above processing.

Table 6 shows a pulse width as a reference for driving limit measurement patterns for each number of droplets simultaneously discharged (rank).

TABLE 6

| Simultaneous Discharge Rank | Display | Pth(n) [μs] 10 | 9 | 8 | 7 | 6 | 5 | 4 | 3 | 2 | 1 |
|---|---|---|---|---|---|---|---|---|---|---|---|
| 1 | A | 0.00 | 0.05 | 0.10 | 0.15 | 0.20 | 0.25 | 0.30 | 0.35 | 0.40 | 0.45 |
| 2 | B | 0.00 | 0.05 | 0.10 | 0.15 | 0.20 | 0.25 | 0.30 | 0.35 | 0.40 | 0.45 |
| 3 | C | 0.00 | 0.05 | 0.10 | 0.15 | 0.20 | 0.25 | 0.30 | 0.35 | 0.40 | 0.45 |
| 4 | D | 0.00 | 0.05 | 0.10 | 0.15 | 0.20 | 0.25 | 0.30 | 0.35 | 0.40 | 0.45 |
| 5 | E | 0.00 | 0.05 | 0.10 | 0.15 | 0.20 | 0.25 | 0.30 | 0.35 | 0.40 | 0.45 |
| 6 | F | 0.00 | 0.05 | 0.10 | 0.15 | 0.20 | 0.25 | 0.30 | 0.35 | 0.40 | 0.45 |
| 7 | G | 0.00 | 0.05 | 0.10 | 0.15 | 0.20 | 0.25 | 0.30 | 0.35 | 0.40 | 0.45 |
| 8 | H | 0.00 | 0.05 | 0.10 | 0.15 | 0.20 | 0.25 | 0.30 | 0.35 | 0.40 | 0.45 |
| 9 | I | 0.00 | 0.05 | 0.10 | 0.15 | 0.20 | 0.25 | 0.30 | 0.35 | 0.40 | 0.45 |
| 10 | J | 0.00 | 0.05 | 0.10 | 0.15 | 0.20 | 0.25 | 0.30 | 0.35 | 0.40 | 0.45 |
| 11 | K | 0.00 | 0.05 | 0.10 | 0.15 | 0.20 | 0.25 | 0.30 | 0.35 | 0.40 | 0.45 |
| 12 | L | 0.00 | 0.05 | 0.10 | 0.15 | 0.20 | 0.25 | 0.30 | 0.35 | 0.40 | 0.45 |

Figure 2:
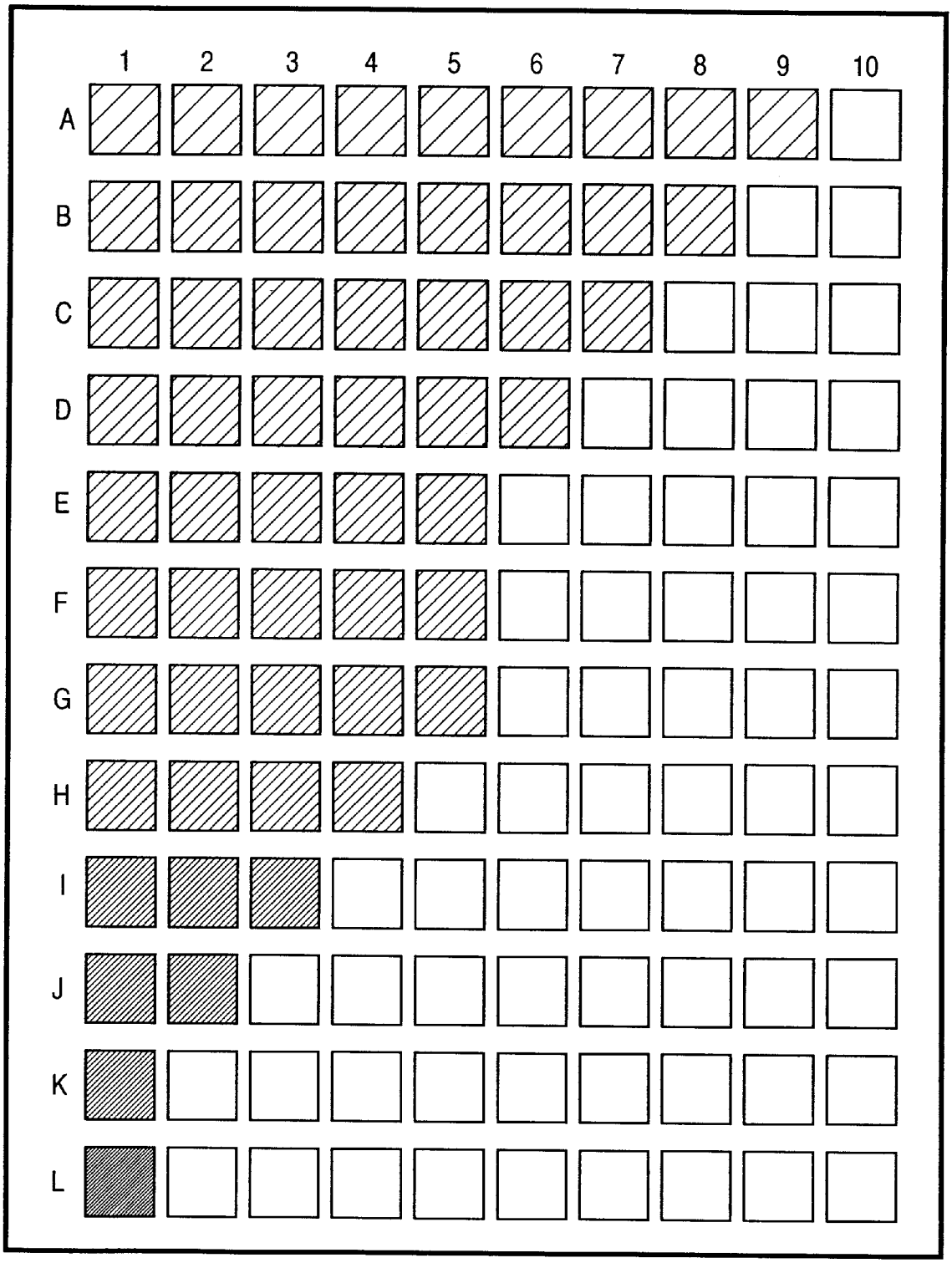
FIG. 2 is a view showing print samples of driving limit measurement patterns in the third embodiment of the present invention.

FIG. 2 shows the printing results of discharge limit measurement patterns printed in this embodiment. Referring to FIG. 2, "A" to "L" on the left side correspond to ranks 1 to 12 of the numbers of droplets simultaneously discharged. FIG. 2 shows only one color, but in practice, patterns are printed in the respective colors with the respective numbers of droplets simultaneously discharged.

An identification symbol corresponding to a pattern in which "fading" indicating a discharge failure is recognized with each number of droplets simultaneously discharged is read from the printing results. This value (rank number) is then input as a discharge limit to the printer main body for each number of droplets simultaneously discharged through the user interface on the external device serving as the host (step S77). The printer main body perform a predetermined computation for a pulse width corresponding to this value to set an optimal driving pulse width (step S78).

Figure 3:
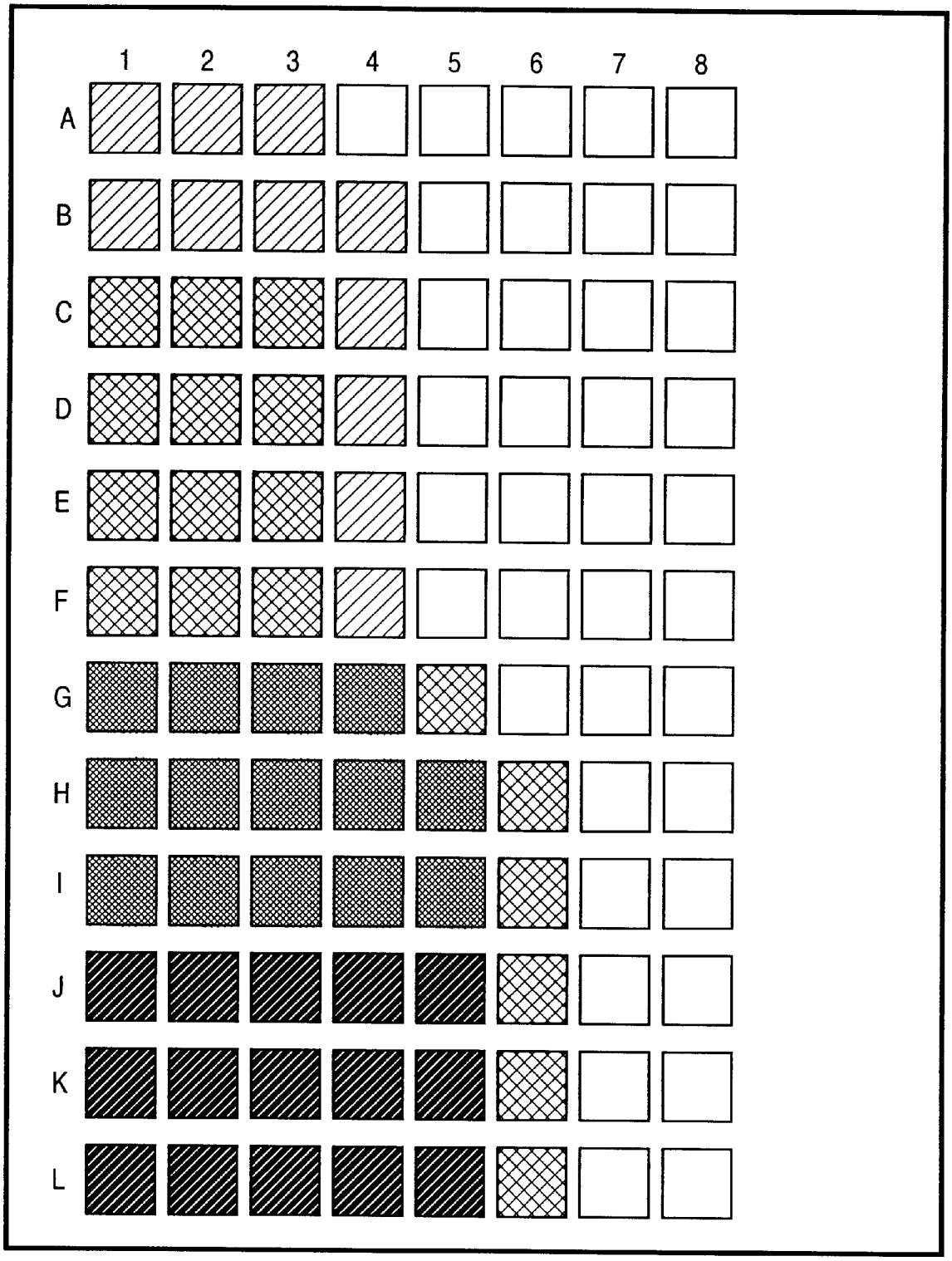
FIG. 3 is a view showing print samples of driving limit measurement patterns in the fourth embodiment of the present invention.

In general, as the number of droplets simultaneously discharged increases, the driving limit pulse width tends to increase. For this reason, the pulse width as the reference for a driving limit measurement pulse may be changed for each number of droplets simultaneously discharged. Table 7 shows the driving limit measurement pulse widths in correspondence with the respective numbers of droplets simultaneously discharged (ranks). FIG. 3 shows the printing results of discharge limit measurement patterns printed according to this table.

TABLE 7

| Simultaneous Discharge Rank | Display | Pth(n) [μs] 1 | 2 | 3 | 4 | 5 | 6 | 7 | 8 |
|---|---|---|---|---|---|---|---|---|---|
| 1 | A | 0.10 | 0.05 | 0.00 | −0.05 | −0.10 | −0.15 | −0.20 | −0.15 |
| 2 | B | 0.15 | 0.10 | 0.05 | 0.00 | −0.05 | −0.10 | −0.15 | −0.20 |
| 3 | C | 0.20 | 0.15 | 0.10 | 0.05 | 0.00 | −0.05 | −0.10 | −0.15 |
| 4 | D | 0.25 | 0.20 | 0.15 | 0.10 | 0.05 | 0.00 | −0.05 | −0.10 |
| 5 | E | 0.30 | 0.25 | 0.20 | 0.15 | 0.10 | 0.05 | 0.00 | −0.05 |
| 6 | F | 0.35 | 0.30 | 0.25 | 0.20 | 0.15 | 0.10 | 0.05 | 0.00 |
| 7 | G | 0.40 | 0.35 | 0.30 | 0.25 | 0.20 | 0.15 | 0.10 | 0.05 |
| 8 | H | 0.45 | 0.40 | 0.35 | 0.30 | 0.25 | 0.20 | 0.15 | 0.10 |
| 9 | I | 0.50 | 0.45 | 0.40 | 0.35 | 0.30 | 0.25 | 0.20 | 0.15 |
| 10 | J | 0.55 | 0.50 | 0.45 | 0.40 | 0.35 | 0.30 | 0.25 | 0.20 |
| 11 | K | 0.60 | 0.55 | 0.50 | 0.45 | 0.40 | 0.35 | 0.30 | 0.25 |
| 12 | L | 0.65 | 0.60 | 0.55 | 0.50 | 0.45 | 0.40 | 0.35 | 0.30 |

Compare the printed patterns in FIG. 3 with those in FIG. 2. In FIG. 2, the positions of patterns in which "fading" is recognized vary, whereas in FIG. 3, such patterns concentrate on almost the middle portion of the chart. In this case, therefore, no practical problem arises even if the number of ranks of pulse widths for actual printing are set to five, from rank 3 to rank 7. This makes it possible to shorten the time taken for driving condition setting.

As described above, according to this embodiment, the numbers of droplets simultaneously discharged are set in a plurality of levels, and actual printing is performed with each ink while the driving pulse width in each level is changed within a predetermined range. The width of a driving pulse used for printing is then determined for each number of droplets simultaneously discharged on the basis of the printing result.

Driving conditions for each printhead can therefore be set more finely in consideration of variations in conditions (power supply capacity and power line resistance) on the printer main body side as well as variations in conditions for the printhead (e.g., heater resistance, the ON resistance of each heater driving element, head wiring resistance, and heater thermal efficiency). This makes it possible to perform stable discharge operation even if the number of droplets simultaneously discharged changes.

[Fourth Embodiment]

In the first to third embodiments, the driving limit measurement pulse width is decreased stepwise, and a predetermined computation is performed for a pulse width with which "fading" has occurred, thereby determining the width of a driving pulse used for printing. In the fourth embodiment, the width of a driving pulse used for printing is directly obtained by obtaining a pulse width corresponding to a driving limit in a state where the driving voltage is decreased by a predetermined value.

This embodiment will be descried below with particular emphasis on the points different from the first to third embodiments.

In the arrangement of the embodiment described above, energy Pow_th applied to a heater with a pulse width Pth at the time of a discharge limit is given by $$Pow_th = C \cdot Vh^2 \times Pth$$

where C is a constant, and Vh is the main body driving voltage.

As described above, $$Pop = A \times Pth$$

then, $$Pow_th = C \cdot (Vh/\sqrt{A})^2 \times Pop$$

Therefore, Pop can be directly obtained by setting a main body driving voltage V to $$Vh/B \ (B = \sqrt{A})$$

This main body driving voltage V is expressed by Vth.

In this case, the value of B is a constant that determines how many times the discharge limit pulse is to be multiplied to obtain a driving pulse. As this value decreases, the possibility of "poor discharge" rises. As the value increases, the possibility of "kogation" or the like rises. According to the present inventor, the value of B is about 1.1 to 1.35, and more preferably falls within the range of 1.15 to 1.25.

More specifically, if A=1.45, then B=√A=1.20. If main body driving voltage V=11 V, then Vth=Vh/√A=9.17 V.

By executing the processing in the first and second embodiments upon changing the main body driving voltage V to Vth, therefore, a driving limit pulse width with which "fading" occurs can be directly obtained as the driving pulse Pop.

Figure 8:
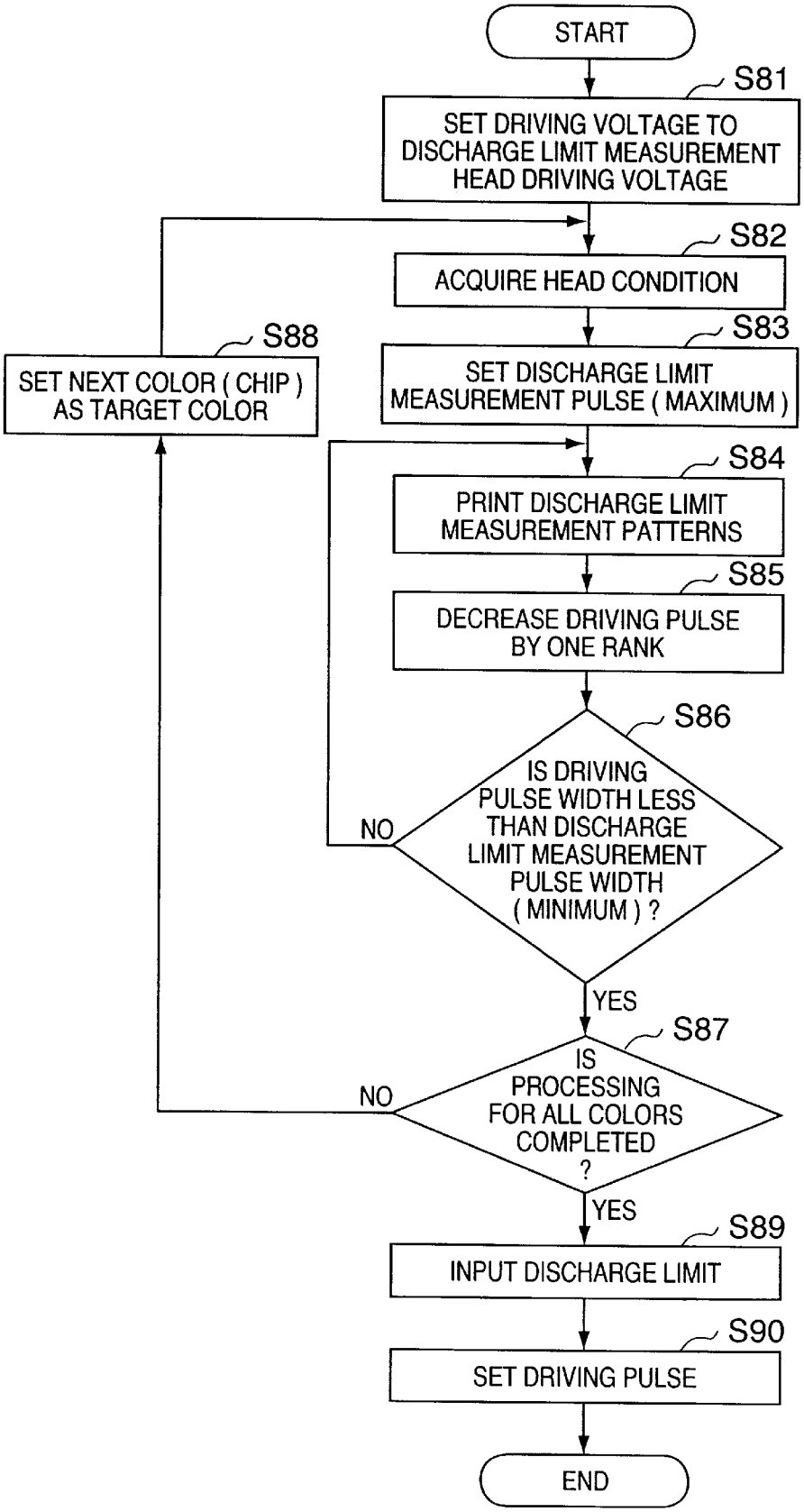
FIG. 8 is flow chart showing processing in the fourth embodiment of the present invention.

The processing in this embodiment will be described below with reference to the flow chart of FIG. 8. First of all, the printhead driving voltage is switched to the value obtained by the above equation, i.e., Vth (step S81). Information such as a heater rank and the rank of the ON resistance of a driving transistor is read from a printhead (step S82).

The minimum value (Pth_min) and maximum value (Pth_max) of the corresponding driving measurement pulse are obtained from the read information, and the driving pulse width is set to the maximum value of the discharge limit measurement pulse: Pth_max (step S83).

The printhead is then driven by using the set pulse to print discharge limit measurement patterns on a printing medium (step S84). In this embodiment, as these measurement patterns, patterns obtained by simultaneously driving a predetermined number of nozzles in each block are used.

The driving pulse width is decreased by one rank corresponding to a predetermined amount (step S85). It is then checked whether the driving pulse width becomes less than the minimum value of the discharge limit measurement pulse: Pth_min (step S86).

The processing from step S84 to step S86 is repeated until the driving pulse width becomes less than the minimum value of the discharge limit measurement pulse. When the driving pulse width becomes less than the minimum value of the discharge limit measurement pulse, the printing of driving limit measurement patterns for one color is terminated.

It is checked whether processing for all colors (inks) is completed (step S87). If the processing is not completed, the next color is set as a target color (step S88). The flow returns to step S82 to print driving limit measurement patterns for each ink (printhead).

An identification symbol corresponding to a pattern in which "fading" indicating a discharge failure of each ink is recognized is read from the printing results. This value (rank number) is then input as a discharge limit to the printer main body through the user interface on the external device serving as the host (step S89). The printer main body sets a pulse width corresponding to this value as an optimal driving pulse width (step S90).

The processing described above is based on the second embodiment. However, the driving voltage for each printhead is set to the value according to the above equation first, and then the processing based on other embodiments may be performed.

As described above, according to this embodiment, since a pulse width with which "fading" has occurred and which is determined as a discharge limit is directly set as a proper driving pulse width, the arithmetic processing required in the first to third embodiments is not required.

[Other Embodiment]

In the embodiments described above, "fading" is visually determined from printing results. However, these embodiments may be configured to automatically determine "fading" by providing a density sensor or the like on the carriage. In this case, a density is detected concurrently with printing, and printing of driving limit measurement patterns is stopped when a change in density is detected. This makes it possible to set driving conditions more efficiently.

Note that a discharge limit may not be determined at the start of "fading" but may be determined at a pulse width with which no ink is discharged or at a timing between the two timings.

In addition, a driving pulse width may be set by using a discharge check sensor, a sensor for acoustically detecting the occurrence of cavitation upon foaming, or the like instead of actually printing patterns on a printing medium.

Furthermore, as is obvious, the value of a driving pulse set in each embodiment described above may be stored in a storage medium in the main body or printhead, and the stored value may be used until the driving condition setting mode is activated next.

Moreover, when, for example, the counted number of times of discharging operation reaches a predetermined number (e.g., $10^8$) or printing corresponding to a predetermined number of sheets in terms of printing sheets of a standard size (e.g., 1,000 in A4 size) is performed, a shift to the driving condition setting mode may be prompted even without any instruction from the user.

In all four embodiments described above, the present invention is applied to the ink-jet printer designed to perform serial printing. However, the present invention can also be applied to any printers for performing printing operation according to printing schemes other than the ink-jet scheme using heat energy (e.g., other ink-jet schemes and thermal scheme) as long as the printhead has a plurality of print element arrays.

As is obvious to a person skilled in the art, the same effects as described above can also be obtained by applying the present invention even to a full-line type printhead having a length corresponding to the maximum length of a printing medium on which printing can be performed as long as it has a plurality of print element arrays.

Each of the embodiments described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called an on-demand type and a continuous type. Particularly, in the case of the on-demand type, the system is effective because, by applying at least one driving signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printing head, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printing head, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full line type printing head having a length corresponding to the width of a maximum printing medium which can be printed by the printer, either the arrangement which satisfies the full-line length by combining a plurality of printing heads as disclosed in the above specification or the arrangement as a single printing head obtained by forming printing heads integrally can be used.

In addition, not only an exchangeable chip type printing head, as described in the above embodiment, which can be electrically connected to the apparatus main unit and can receive an ink from the apparatus main unit upon being mounted on the apparatus main unit but also a cartridge type printing head in which an ink tank is integrally arranged on the printing head itself can be applicable to the present invention.

It is preferable to add recovery means for the printing head, preliminary auxiliary means, and the like provided as an arrangement of the printer of the present invention since the printing operation can be further stabilized. Examples of such means include, for the printing head, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printing head or by combining a plurality of printing heads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention. In this case, an ink may be situated opposite electrothermal transducers while being held in a liquid or solid state in recess portions of a porous sheet or through holes, as described in Japanese Patent Laid-Open No. 54-56847 or 60-71260. In the present invention, the above-mentioned film boiling system is most effective for the above-mentioned inks.

The present invention can be applied to a system constituted by a plurality of devices (e.g., host computer, interface, reader, printer) or to an apparatus comprising a single device (e.g., copying machine, facsimile machine).

Further, the object of the present invention can also be achieved by providing a storage medium storing program codes for performing the aforesaid processes to a computer system or apparatus (e.g., a personal computer), reading the program codes, by a CPU or MPU of the computer system or apparatus, from the storage medium, then executing the program.

In this case, the program codes read from the storage medium realize the functions according to the embodiments, and the storage medium storing the program codes constitutes the invention.

Further, the storage medium, such as a floppy disk, a hard disk, an optical disk, a magneto-optical disk, CD-ROM, CD-R, a magnetic tape, a non-volatile type memory card, and ROM can be used for providing the program codes.

Furthermore, besides aforesaid functions according to the above embodiments are realized by executing the program codes which are read by a computer, the present invention includes a case where an OS (operating system) or the like working on the computer performs a part or entire processes in accordance with designations of the program codes and realizes functions according to the above embodiments.

Furthermore, the present invention also includes a case where, after the program codes read from the storage medium are written in a function expansion card which is inserted into the computer or in a memory provided in a function expansion unit which is connected to the computer, CPU or the like contained in the function expansion card or unit performs a part or entire process in accordance with designations of the program codes and realizes functions of the above embodiments.

If the present invention is realized as a storage medium, program codes corresponding to the above mentioned flowcharts (FIGS. 5 to 8) are to be stored in the storage medium.

As many apparently widely different embodiments of the present invention can be made without departing from the spirit and scope thereof, it is to be understood that the invention is not limited to the specific embodiments thereof except as defined in the appended claims

What is claimed is:

1. A printing apparatus for performing printing on a printing medium by a printhead having a plurality of print elements, comprising:

driving means for generating a driving pulse signal supplied to the printhead;

test pattern printing means for printing test patterns obtained by changing a number of simultaneously driven print elements of the plurality of print elements and changing a pulse width of the driving signal stepwise; and control means for controlling a pulse width of a driving signal generated by said driving means on the basis of a value around a boundary of a pulse width with which a print element is not properly driven obtained from the test patterns.

2. The apparatus according to claim 1, further comprising boundary value deriving means for obtaining the value around the boundary.

3. The apparatus according to claim 1, wherein said printhead comprises storage means for storing information about characteristics of the print element, and said test pattern printing means determines a range in which the pulse width of the driving signal changes by reading out the information from said storage means.

4. The apparatus according to claim 1, wherein said control means calculates, from the value around the boundary, a pulse width of a driving signal in a case where the number of print elements simultaneously driven differs from the number used for printing the test patterns.

5. The apparatus according to claim 1, wherein said control means calculates the pulse width of the driving signal by performing a predetermined computation for the value around the boundary.

6. The apparatus according to claim 1, wherein said test pattern printing means prints the patterns while decreasing an amplitude of the driving signal at a predetermined rate, and said control means controls the pulse width of the driving signal to the value around the boundary.

7. The apparatus according to claim 1, wherein said test pattern printing means includes storage means for storing information used to print the test patterns.

8. The apparatus according to claim 2, wherein said boundary value deriving means includes a density sensor for detecting a density of the test patterns, and obtains the value around the boundary from a change in detected density.

9. The apparatus according to claim 1, wherein said printhead is an ink-jet printhead for performing printing by discharging ink.

10. The apparatus according to claim 9, wherein the printhead is a printhead for discharging ink by using heat energy, the printhead having a heat energy transducer for generating heat energy applied to the ink.

11. A driving condition setting method for a printhead in a printing apparatus including a printhead having a plurality of print elements and driving means for generating a driving pulse signal supplied to the printhead, comprising:

the test pattern printing step of printing test patterns obtained by changing a number of simultaneously driven print elements of the plurality of print elements and changing a pulse width of the driving signal stepwise; and the control step of controlling a pulse width of a driving signal generated by the driving means on the basis of a value around a boundary of a pulse width with which a print element is not properly driven obtained from the test patterns.

12. The method according to claim 11, wherein the value around the boundary is obtained from a boundary value deriving step.

13. The method according to claim 11, wherein the printhead comprises storage means for storing information about characteristics of the print element, and the test pattern printing step comprises determining a range in which the pulse width of the driving signal changes by reading out the information from the storage means.

14. The method according to claim 11, wherein the control step comprises calculating, from the value around the boundary, a pulse width of a driving signal in a case where the number of print elements simultaneously driven differs from the number used for printing the test patterns.

15. The method according to claim 11, wherein the control step comprises calculating the pulse width of the driving signal by performing a predetermined computation for the value around the boundary.

16. The method according to claim 11, wherein the test pattern printing step comprises printing the patterns while decreasing an amplitude of the driving signal at a predetermined rate, and the control step comprises controlling the pulse width of the driving signal to the value around the boundary.

17. The method according to claim 11, wherein the test pattern printing step comprises printing the test patterns in accordance with information read out from the storage means.

18. The method according to claim 12, wherein the printing apparatus includes a density sensor for detecting a density of the test patterns, and the deriving step comprises obtaining the value around the boundary from a change in density detected by the density sensor.

19. A storage medium storing a program for implementing a driving condition setting method for a printhead in a printing apparatus including a printhead having a plurality of print elements and driving means for generating a driving pulse signal supplied to the printhead, the program including a program code corresponding to:

the test pattern printing step of printing test patterns obtained by changing a number of simultaneously driven print elements of the plurality of print elements and changing a pulse width of the driving signal stepwise; and the control step of controlling a pulse width of a driving signal generated by the driving means on the basis of a value around a boundary of a pulse width with which a print element is not properly driven obtained from the test patterns.

* * * * *